US011353258B2

(12) United States Patent
Lee et al.

(10) Patent No.: US 11,353,258 B2
(45) Date of Patent: Jun. 7, 2022

(54) REFRIGERATOR

(71) Applicant: SAMSUNG ELECTRONICS CO., LTD., Suwon-si (KR)

(72) Inventors: Chomin Lee, Suwon-si (KR); Oungu Lee, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/153,447

(22) Filed: Jan. 20, 2021

(65) Prior Publication Data

US 2021/0231364 A1 Jul. 29, 2021

(30) Foreign Application Priority Data

Jan. 23, 2020 (KR) ..... 10-2020-0009477

(51) Int. Cl.

| | |
|---|---|
| ***F25D 25/02*** | (2006.01) |
| ***A47B 96/02*** | (2006.01) |
| *F25D 25/04* | (2006.01) |

(52) U.S. Cl.

CPC ..... *F25D 25/024* (2013.01); *A47B 96/024* (2013.01); *F25D 25/02* (2013.01); *F25D 25/04* (2013.01)

(58) Field of Classification Search

CPC ..... F25D 25/024; F25D 25/02; F25D 25/04; A47B 96/024

See application file for complete search history.

(56) References Cited

U.S. PATENT DOCUMENTS

2001/0025508 A1 10/2001 Nakajima et al.

FOREIGN PATENT DOCUMENTS

| | | |
|---|---|---|
| JP | 2017-32209 | 2/2017 |
| KR | 20-0125481 | 11/1998 |
| KR | 10-0229189 | 11/1999 |
| KR | 10-0585696 | 6/2006 |
| KR | 10-0775822 | 11/2007 |
| KR | 10-0895140 | 5/2009 |
| KR | 10-2009-0125317 | 12/2009 |
| KR | 10-0954518 | 4/2010 |
| KR | 10-1218299 | 1/2013 |

OTHER PUBLICATIONS

International Search Report dated May 14, 2021 from International Application No. PCT/KR2021/000642, 3 pages.

*Primary Examiner* — Kimberley S Wright

(74) *Attorney, Agent, or Firm* — Staas & Halsey LLP

(57) ABSTRACT

Provided is a refrigerator including: a main body; a storage compartment provided in the main body, the storage compartment configured to have a shelf arranged therein; and shelf fixing devices provided at opposite sidewalls inside the storage compartment to fix the shelf, wherein the shelf fixing device includes: a shelf support portion configured to support a lower side of the shelf, and move downward as a load the shelf increases; a shelf fixing portion configured to fix the shelf at an upper side of the shelf, and move downward in linkage with the shelf support portion; and a connecting portion configured to connect the shelf support portion to the shelf fixing portion, and adjust a distance between the shelf support portion and the shelf fixing portion according to the load on the shelf such that a fixing force on the shelf is changed.

20 Claims, 15 Drawing Sheets

REFRIGERATOR

CROSS-REFERENCE TO RELATED APPLICATION

This application is based on and claims priority under 35 U.S.C. § 119 to Korean Patent Application No. 10-2020-0009477, filed on Jan. 23, 2020 in the Korean Intellectual Property Office, the disclosure of which is incorporated herein by reference.

BACKGROUND

1. Field

The disclosure relates to a refrigerator having a shelf fixing apparatus in which the fixing force of fixing a shelf is changed according to a load of food stored on the shelf.

2. Description of the Related Art

In general, a refrigerator is a home appliance that includes a main body having a storage compartment, a cold air supply device configured to supply cold air to the storage compartment, and doors configured to open and close the storage compartment, to keep food fresh.

The storage compartment has a plurality of shelves formed therein to keep food thereon.

The shelves are supported on opposite sidewalls of the storage compartment, and are generally provided in a structure in which the shelves are placed on support portions provided on the opposite sidewalls of the storage compartment.

Due to the structure in which the shelf is mounted and supported on the support portion, when the load of food stored on the shelf is increased, the shelf may be separated from the support portion.

SUMMARY

According to an aspect of the disclosure, there is provided a refrigerator including: a main body; a storage compartment provided in the main body so as to be opened at a front side thereof, the storage compartment configured to have a shelf arranged therein; and shelf fixing devices provided at opposite sidewalls inside the storage compartment to fix the shelf, wherein the shelf fixing device includes: a shelf support portion configured to support a lower portion of the shelf, and move downward as a load of food stored on the shelf increases; a shelf fixing portion configured to fix the shelf at an upper side of the shelf, and move downward together with the shelf support portion in linkage with the shelf support portion; and a connecting portion configured to connect the shelf support portion to the shelf fixing portion, and allowing the shelf fixing portion to have a moving length longer than a moving length of the shelf support portion to adjust a distance between the shelf support portion and the shelf fixing portion according to the load of the food stored on the shelf such that a fixing force on the shelf is changed.

The connecting portion may include a pair of gears each rotating in linkage with a corresponding one of the shelf support portion and the shelf fixing portion, the pair of gears having different sizes.

The connecting portion may include: a first gear engaged with the shelf support portion and rotating relative to the shelf support portion; and a second gear engaged with the shelf fixing portion and the first gear and rotating relative to the shelf fixing portion and the first gear and having a size smaller than a size of the first gear.

The shelf fixing device may include a pair of shelf fixing devices at each of the opposite sidewalls of the storage compartment, and each of the opposite sidewalls may include a pair of insertion grooves into which the pair of shelf fixing devices are inserted.

The shelf fixing device may be inserted into the insertion groove, and further may include: a case having a first opening provided to be open at an upper side thereof and a second opening provided to be open in a direction opposite to a direction in which the shelf fixing device is inserted into the insertion groove; a first cover configured to cover the first opening; a second cover configured to cover the second opening; and an elastic member elastically supporting a lower portion of the shelf support portion.

The case may include a first guide protrusion configured to guide the shelf support portion to move in upper and lower side directions, and a second guide protrusion configured to guide the shelf fixing portion to move in the upper and lower side directions.

The shelf support portion may include a first guide groove guided by the first guide protrusion, a first rack gear engaged with the first gear, a support plate protruded outside of the case to support the shelf, and a first support portion on which one side of the elastic member is supported.

The shelf fixing portion may include a second guide groove guided by the second guide protrusion, a second rack gear engaged with the second gear, and a fixing protrusion protruded outside of the case to fix the shelf.

The second cover may include a first opening portion to form a space in which the support plate protruded outside of the case is movable in the upper and lower side directions, and a second opening to form a space in which the fixing protrusion protruded outside of the case is movable in the upper and lower side directions.

The case may include a first rotation shaft to which the first gear is fixed so as to enable a rotation, a second rotation shaft to which the second gear is fixed so as to enable a rotation, and a second support portion on which an other side of the elastic member is supported.

The shelf may have opposite side edges thereof formed with fixing grooves that are fixed by the fixing protrusions.

The shelf may have opposite side edges to which fixing members allowing the shelf fixing portion to fix the shelf are coupled, the fixing members including fixing grooves that are fixed by the fixing protrusion.

The connecting portion may include: a first rotating member including a first rotation hole serving as a center of rotation, a first extension portion formed to extend from the first rotation hole in a direction toward the shelf support portion to be connected to the shelf support portion, and a second extension portion formed to extend from the first rotation hole in a direction toward the shelf fixing portion; and a second rotating member including a second rotation hole serving as a center of rotation, a third extension portion formed to extend from the second rotation hole in a direction toward the shelf support portion to be connected to the second extension portion, and a fourth extension portion formed to extend from the second rotation hole in a direction toward the shelf fixing portion to be connected to the shelf fixing portion.

A distance between an end tip of the second extension portion and a center of the first rotation hole may be longer than a distance between an end tip of the second extension portion and the center of the first rotation hole, and a distance between an end tip of the fourth extension portion and a center of the second rotation hole may be longer than a distance between an end tip of the third extension portion and the center of the second rotation hole.

The shelf support portion may include a first connecting portion to which the first extension portion is connected, and the shelf fixing portion may include a second connecting portion to which the fourth extension portion is connected.

According to another aspect of the disclosure, there is provided a refrigerator including: a main body; a storage compartment provided in the main body so as to be opened at a front side thereof, the storage compartment configured to have a shelf arranged therein; and shelf fixing devices provided at opposite sidewalls inside the storage compartment to fix the shelf, wherein the shelf fixing device includes: a shelf support portion configured to support a lower portion of the shelf, and move downward as a load of food stored on the shelf increases; a shelf fixing portion configured to fix the shelf at an upper side of the shelf, and move downward together with the shelf support portion in linkage with the shelf support portion; and a connecting portion provided as a pair of gears and configured to connect the shelf support portion to the shelf fixing portion, the connecting portion allowing the shelf fixing portion and the shelf support portion to have different moving lengths on the basis of a gear ratio of the pair of gears such that a fixing force on the shelf is changed according to the load of the food stored on the shelf.

The pair of gears may include: a first gear engaged with the shelf support portion and rotating relative to the shelf support portion; and a second gear engaged with the shelf fixing portion and the first gear and rotating relative to the shelf fixing portion and the first gear and having a number of rotations larger than a number of rotations of the first gear.

The shelf support portion may include a first rack gear engaged with the first gear, and a support plate configured to support the shelf, and the shelf fixing portion may include a second rack gear engaged with the second gear, and a fixing protrusion configured to fix the shelf.

The shelf may have opposite side edges thereof formed with fixing grooves that are fixed by the fixing protrusions.

As the load of the food stored on the shelf increases, a difference between a distance moved downward by the shelf fixing portion and a distance moved downward by the shelf support portion may be reduced to thereby increase the fixing force with which the fixing protrusion is fixed to the fixing groove.

Additional aspects of the disclosure will be set forth in part in the description which follows and, in part, will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
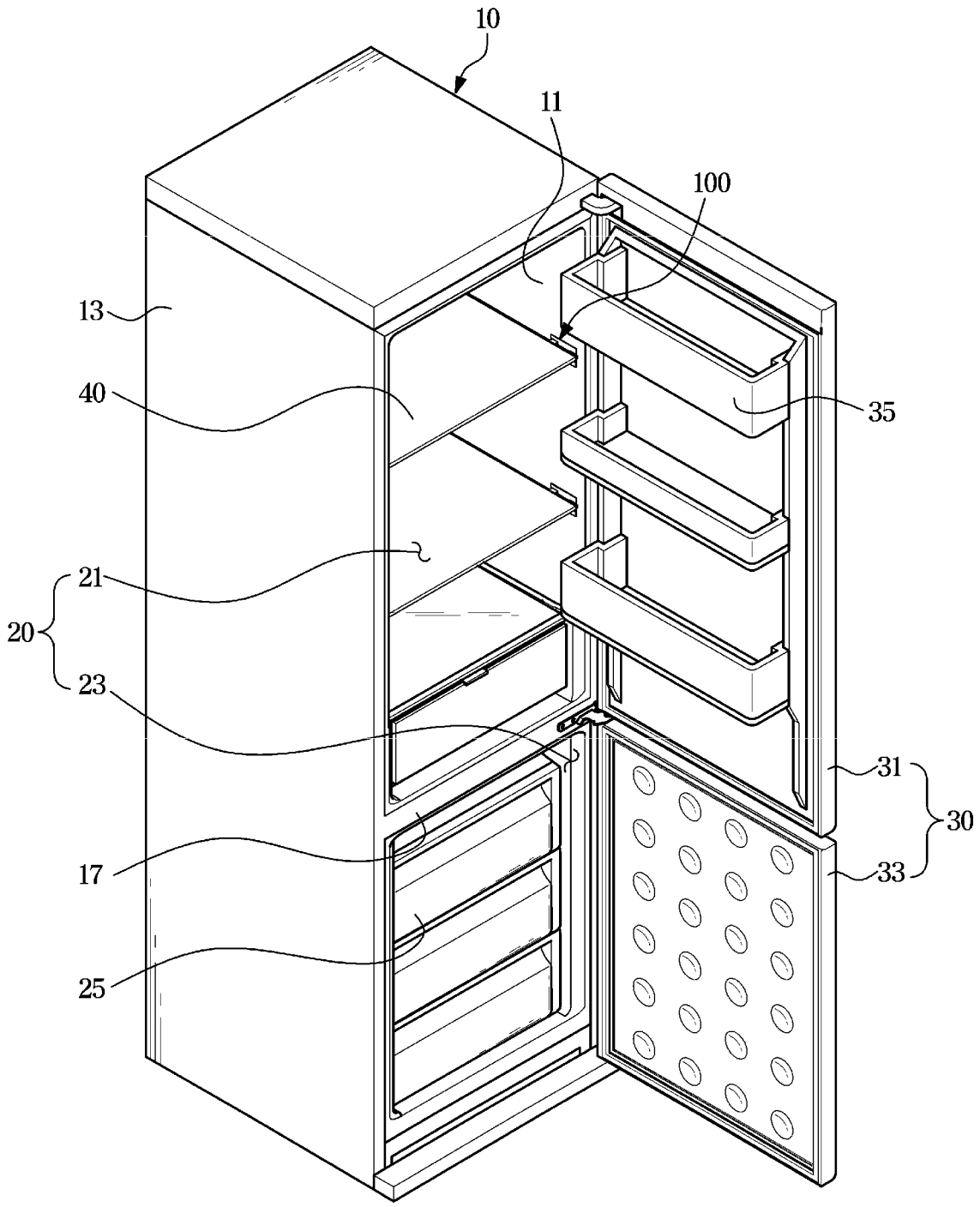
FIG. 1 is a perspective view illustrating a refrigerator according to an embodiment of the disclosure, which shows a state in which doors of the refrigerator are open.

Embodiments and features as described and illustrated in the disclosure are only preferred examples, and various modifications thereof may also fall within the scope of the disclosure.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "include", "comprise" and/or "have" when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or section discussed below could be termed a second element, component, region, layer or section without departing from the teachings of the disclosure. Descriptions shall be understood as to include any and all combinations of one or more of the associated listed items when the items are described by using the conjunctive term "~and/or~," or the like.

The terms "front", "rear", "upper", "lower", "top", and "bottom" as herein used are defined with respect to the drawings, but the terms may not restrict the shape and position of the respective components.

Hereinafter, embodiments of the disclosure will be described in detail with reference to the accompanying drawings.

Therefore, it is an object of the disclosure to provide a refrigerator in which the fixing force of fixing a shelf is increased as the load of food stored on the shelf increases.

FIG. 1 is a perspective view illustrating a refrigerator according to an embodiment of the disclosure, which shows a state in which doors of the refrigerator are open.

Referring to FIG. 1, a refrigerator includes a main body 10, a storage compartment 20 provided as a plurality of units thereof in the main body 10 to be opened at a front side thereof, and doors 30 to open and close the opened front side of the storage compartment 20.

The main body 10 may include an inner case 11 forming the storage compartment 20 and an outer case 13 forming the external appearance of the refrigerator 1. An insulation material (15 in FIG. 2) may be foamed between the inner case 11 and the outer case 13 to prevent cold air from flowing out of the storage compartment 20.

The main body 10 is provided at a rear lower side thereof with a machine room (not shown) in which a compressor (not shown) for compressing a refrigerant and a condenser (not shown) for condensing the refrigerant compressed by the compressor.

The storage compartment 20 may be divided into a refrigerating compartment 21 as an upper storage compartment and a freezing compartment 23 as a lower storage compartment by a partition wall 17. A plurality of shelves 40 for storing food or the like may be provided in the storage compartment 20 to store food thereon. Each of the plurality of shelves 40 may be supported and fixed by shelf fixing devices 100 provided on opposite sidewalls of the storage compartment 20. In addition, a storage container 25 capable of storing food or the like may be provided inside the storage compartment 20. Details of the shelf fixing device 100 and a method of installing the shelf fixing device 100 on the opposite sidewalls of the storage compartment 20 will be described below.

The refrigerating compartment 21 and the freezing compartment 23 may be opened and closed by a refrigerating compartment door 31 and a freezing compartment door 33 that are rotatably coupled to the main body 10, respectively, and a plurality of door guards 35 may be installed on rear surfaces of the doors 30 to store food or the like therein.

The refrigerator 1 may include a cold air supply device (not shown) that supplies cold air to the storage compartment 20. The cold air supply device includes a compressor and a condenser installed in the machine room, an evaporator (not shown) installed at a rear surface of the storage compartment 20 to generate cold air, a blower fan (not shown) provided above the evaporator so that the cold air generated by the evaporator is supplied to the storage compartment 20, and a cold air duct (not shown) that guides the cold air induced by the blower fan to the storage compartment 20 and discharges the cold air to the storage compartment 20.

Figure 2:
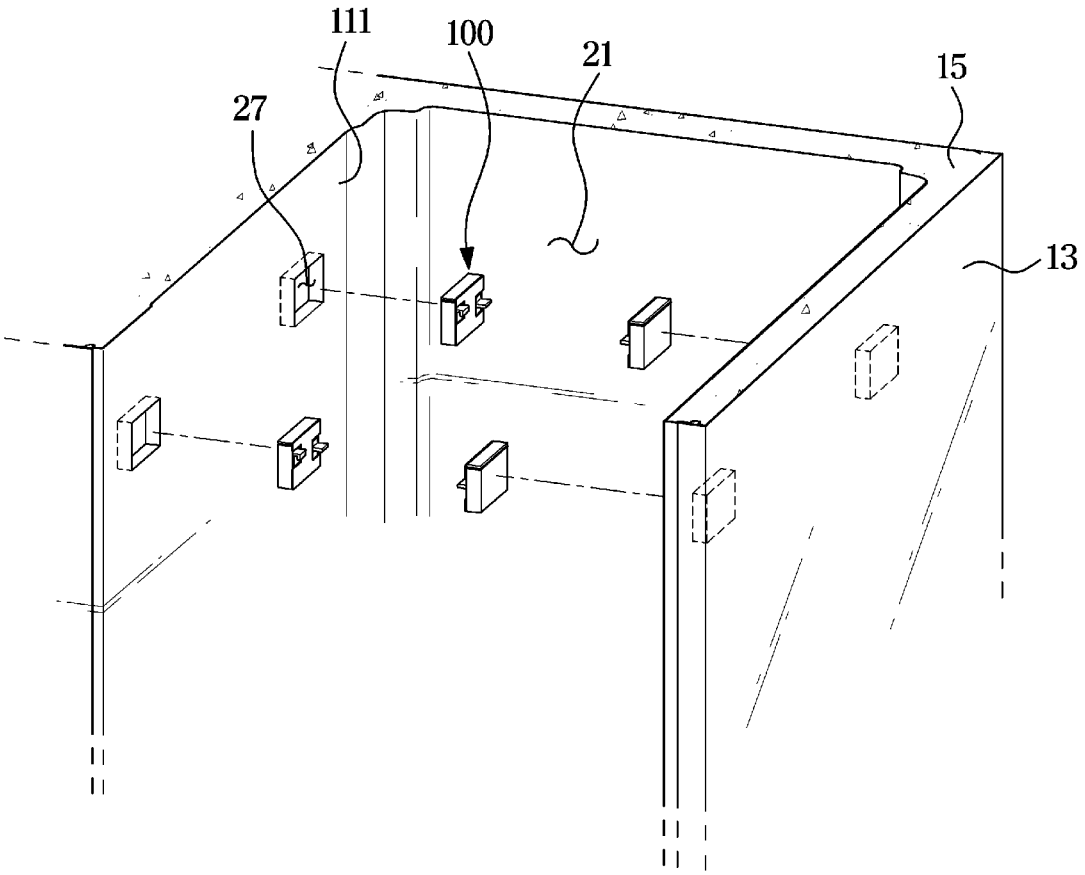
FIG. 2 is a view illustrating a state in which shelf fixing devices are inserted into insertion grooves formed on opposite sidewalls of a storage compartment according to an embodiment of the disclosure.
Figure 3:
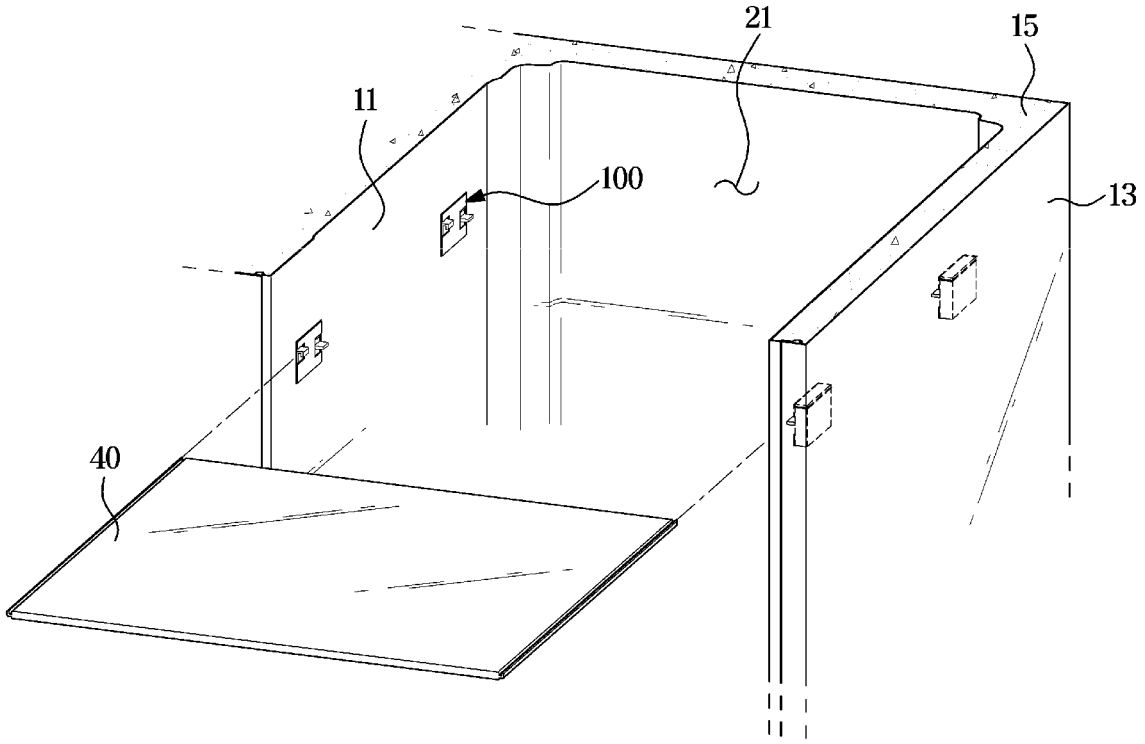
FIG. 3 is a view illustrating a state in which a shelf is inserted into a storage compartment to be fixed by a shelf fixing device according to an embodiment of the disclosure.
Figure 4:
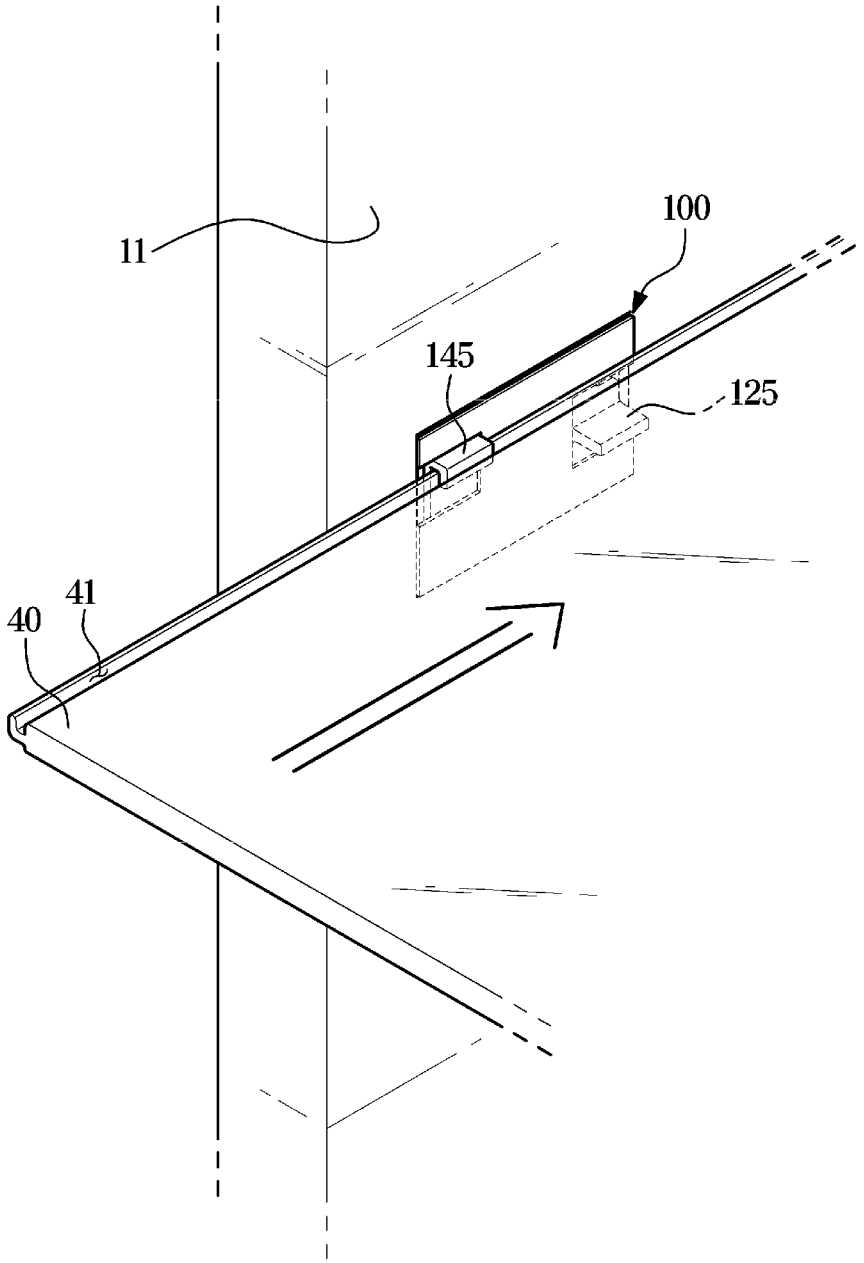
FIG. 4 is a view illustrating a state in which a shelf is inserted between a shelf support portion and a shelf fixing portion of a shelf fixing device and fixed according to an embodiment of the disclosure.

FIG. 2 is a view illustrating a state in which shelf fixing devices are inserted into insertion grooves formed on opposite sidewalls of a storage compartment according to an embodiment of the disclosure. FIG. 3 is a view illustrating a state in which a shelf is inserted into a storage compartment to be fixed by a shelf fixing device according to an embodiment of the disclosure. FIG. 4 is a view illustrating a state in which a shelf is inserted between a shelf support portion and a shelf fixing portion of a shelf fixing device and fixed according to an embodiment of the disclosure.

Referring to FIGS. 2 to 4, the plurality of shelves 40 may be disposed in the refrigerating compartment 21 of the storage compartment 20. Insertion grooves 27 into which the shelf fixing devices 100 are insertedly installed may be formed on opposite sidewalls of the refrigerating compartment 21. The shelf fixing device 100 may include a pair of shelf fixing devices 100 that are provided on each of the opposite sidewalls of the refrigerating compartment 21 to fix one shelf. The insertion grooves 27 may include a pair of insertion holes 27 that are formed on each of the opposite sidewalls of the refrigerating compartment 21 so as to correspond to the shelf fixing devices 100.

After the shelf fixing devices 100 are installed on the opposite sidewalls of the refrigerating compartment 21, the shelf 40 may be inserted into the refrigerating compartment 21. The shelf 40 may be inserted between a shelf support portion 120 and a shelf fixing portion 140 of the shelf fixing device 100. As will be described below in detail, the shelf 40 may be supported by the shelf support portion 120 and fixed by the shelf fixing portion 140.

Although the following drawings illustrate a Bottom Mounted Freezer (BMF) type refrigerator in which the refrigerating compartment 21 is disposed at the top and the freezing compartment 23 is disposed at the bottom, the disclosure is not limited thereto, and the shelf fixing device 100 may be applied to different types of refrigerators.

Figure 5:
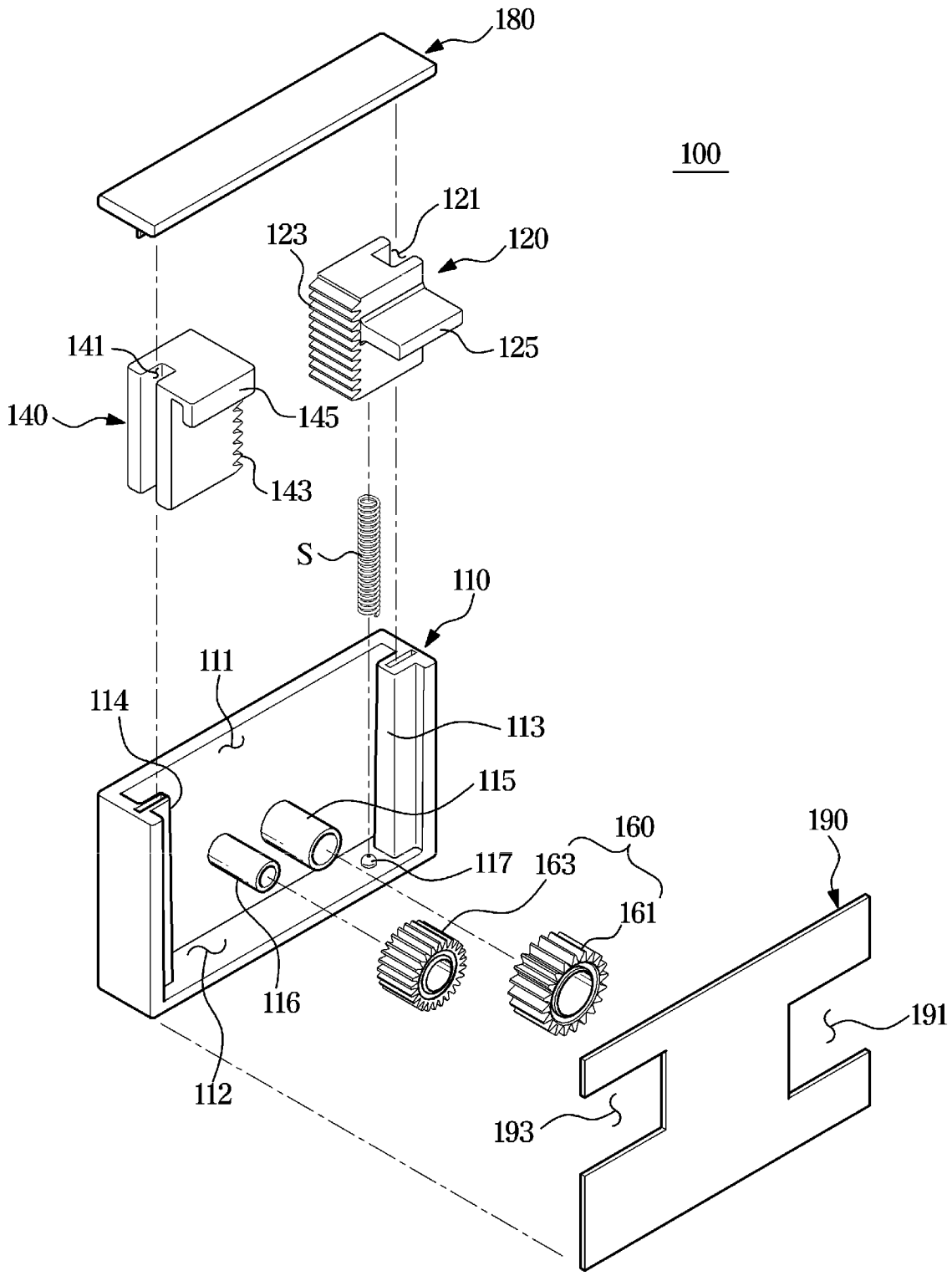
FIG. 5 is an exploded perspective view illustrating a shelf fixing device according to an embodiment of the disclosure.
Figure 6:
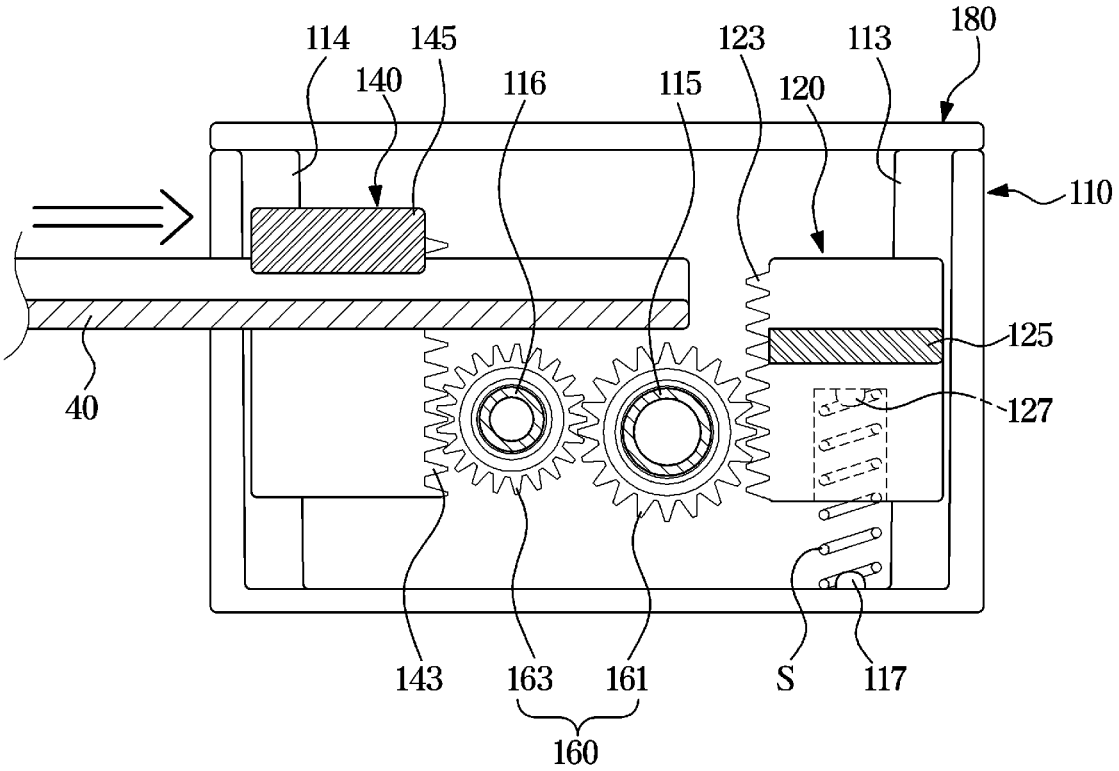
FIG. 6 is a cross-sectional view illustrating a state in which a shelf is inserted between a shelf fixing portion and a shelf support portion of a shelf fixing device according to an embodiment of the disclosure.

FIG. 5 is an exploded perspective view illustrating a shelf fixing device according to an embodiment of the disclosure. FIG. 6 is a cross-sectional view illustrating a state in which a shelf is inserted between a shelf fixing portion and a shelf support portion of a shelf fixing device according to an embodiment of the disclosure.

Referring to FIGS. 5 and 6, the shelf fixing device 100 includes a case 110, the shelf support portion 120 provided inside the case 110 and supporting the shelf 40, the shelf fixing portion 140 provided inside the case 110 40 to fix the shelf 40, a connecting portion 160 arranged inside the case 110 to connect the shelf support portion 120 to the shelf fixing portion 140, and an elastic member S elastically supporting the shelf support portion 120 at a lower portion of the shelf support portion 120.

The cases 110 may be inserted into the pair of insertion grooves 27 formed on each of the opposite sidewalls of the storage compartment 20 (see FIG. 2). The case 110 has a first opening 111 that is opened at the top and a second opening 112 that is opened in a direction opposite to a direction in which the case 110 is inserted into the insertion groove 27 (see FIG. 2). Inside the case 110, the shelf support portion 120, the shelf fixing portion 140, the connecting portion 160, and the elastic member S may be provided. The shelf support portion 120, the shelf fixing portion 140, the connecting portion 160, and the elastic member S may be arranged inside the case 110 through the first opening 111 and the second opening 112.

The shelf fixing device 100 may further include a first cover 180 to cover the first opening 111 of the case 110 and a second cover 190 to cover the second opening 112 of the case 100. The second cover 190 may include a first opening portion 191 through which a support plate 125 of the shelf support portion 120 is protruded, and a second opening portion 193 through which a fixing protrusion 145 of the shelf fixing portion 140 is protrudes, which will be described below.

The case 110 may include a first guide protrusion 113 that guides the shelf support portion 120 to move in the vertical direction, and a second guide protrusion 114 that guides the shelf fixing portion 140 to move in the vertical direction. The first guide protrusion 113 may be provided on one of opposite sidewalls of the case 110. The second guide protrusion 114 may be provided on a sidewall opposite to the one sidewall of the case 110 on which the first guide protrusion 113 is provided.

The case 110 includes a first rotation shaft 115 to which a first gear 161 of the connecting portion 160, which will be described below, is fixed so as to enable a rotation, a second rotation shaft 116 to which a second gear 163, which will be described below, is fixed so as to enable a rotation, and a second support portion 117 on which the elastic member S is supported.

The shelf support portion 120 may include a first guide groove 121 guided by the first guide protrusion 113 of the case 110, a first rack gear engaged with the first gear 161 of the connecting portion 160, a support plate 125 protruding to the outside of the case 110 through the first opening portion 191 of the second cover 190 to support the shelf 40, and a first support portion 127 on which the elastic member S is supported.

The first guide groove 121 of the shelf support portion 120 is guided by the first guide protrusion 113 of the case 110 so that the shelf support portion 120 may be moved in the vertical direction.

When the shelf support portion 120 moved in the vertical direction, the first rack gear 123, by being engaged with the first gear 161 of the connecting portion 160, may allow the first gear 161 to be rotated. When the shelf support portion 120 is moved downward, the first gear 161 may be rotated clockwise around the first rotation shaft 115.

The support plate 125 may protrude to the outside of the case 110 through the first opening portion 191 of the second cover 190 to support the lower portion of the shelf 40. The first opening 191 may form a space in which the support plate 125 is moved in the vertical direction when the shelf support portion 120 is moved in the vertical direction.

The first support portion 127 may be provided to have one side of the elastic member S elastically supported thereon. The other side of the elastic member S may be elastically supported on the second support 117 provided on the case 110. The elastic member S has one side and the other side thereof elastically supported on the shelf support portion 120 and the lower surface of the case 110, respectively, and when the load of the shelf 40 is light, the shelf support portion 120 may be located at the highest position inside the case 110. That is, when food is not stored on the shelf 40, the shelf support portion 120 may be located at the highest position inside the case 110 by the elastic member S. When the shelf support portion 120 is referred to as being located at the highest position inside the case 110, the highest position may represent the height of the shelf support portion 120 relative to the height of the shelf support portion 120 when food is stored on the shelf 40. That is, when the shelf 40 is not fixed by the shelf fixing device 100, the shelf support portion 120 may be located at the highest position inside the case 110.

The shelf fixing portion 140 may include a second guide groove 141 guided by the second guide protrusion 114 of the case 110, a second rack gear 143 engaged with the second gear 163 of the connecting portion 160, and a fixing protrusion 145 protruded to the outside of the case 110 through the second opening portion 193 of the second cover 190 to fix the shelf 40.

As the second guide groove 141 of the shelf fixing portion 140 is guided by the second guide protrusion 114 of the case 110, the shelf fixing portion 140 may be moved in the vertical direction.

The second rack gear 143 due to being engaged with the second gear 163 of the connecting portion 160 may, when the second gear 163 is rotated, allow the shelf fixing portion 140 to be moved in the vertical direction. When the shelf support portion 120 is moved downward, the first gear 161 is rotated clockwise around the first rotation shaft 115, and the second gear 163 is rotated counterclockwise around the second rotation shaft 116. When the second gear 163 is rotated counterclockwise, the second rack gear 143 engaged with the second gear 163 may allow the shelf fixing portion 140 to be moved downward.

The fixing protrusion 145 may protrude to the outside of the case 110 through the second opening portion 193 of the second cover 190 to fix the shelf 40 at the upper side of the shelf 40. The second opening portion 193 may form a space in which the fixing protrusion 145 is moved in the vertical direction when the shelf fixing portion 140 is moved in the vertical direction.

In order that the shelf 40 is fixed by the fixing protrusion 145, fixing grooves 41 may be provided on opposite side edges of the shelf 40. As the fixing protrusion 145 is inserted into the fixing groove 41, the shelf 40 is prevented from being separated (see FIGS. 4 and 8).

The connecting portion 160 may be disposed between the shelf support portion 120 and the shelf fixing portion 140 to connect the shelf support portion 120 to the shelf fixing portion 140. The connecting portion 160 may be provided with a pair of gears 161 and 163 that are rotated in linkage with the shelf support portion 120 and the shelf fixing portion 140, respectively. The connecting portion 160 may include the first gear 161 engaged with the first rack gear 123 of the shelf support portion 120 and rotating relative to the first rack gear 123 and the second gear 163 engaged with the second rack gear 143 of the shelf fixing portion 140 and rotating relative to the second rack gear 143.

The first gear 161 may be fixed to the first rotation shaft 115 of the case 110 so as to enable a rotation. The first gear 161 may be disposed between the first rack gear 123 of the shelf support portion 120 and the second gear 163 to be engaged with the first rack gear 123 and the second gear 163. When the shelf support portion 120 is moved downward by the load of food stored on the shelf 40, the first gear 161 may be rotated clockwise about the first rotation shaft 115. In this case, the second gear 163 may be rotated counterclockwise around the second rotation shaft 116 by the first gear 161.

The second gear 163 may be fixed to the second rotation shaft 116 of the case 110 so as to enable a rotation. The second gear 163 is disposed between the first gear 161 and the second rack gear 143 of the shelf fixing portion 140 to be engaged with the first gear 161 and the second rack gear 143. When the shelf support portion 120 is moved downward by the load of food stored on the shelf 40 and thus the first gear 161 is rotated clockwise around the first rotation shaft 115, the second gear 163 engaged with the first gear 161 may be rotated counterclockwise around the second rotation shaft 116. In this case, the second rack gear 143 engaged with the second gear 163 may be moved downward, so that the shelf fixing portion 140 may be moved downward.

The first gear 161 and the second gear 163 may be provided to have different sizes. In order to set the distance moved by the support fixing portion 140 downward to be larger than the distance moved by the shelf support portion 120 downward when the shelf support portion 120 is moved downward by the load of food stored on the shelf 40, the first gear 161 may be provided to have a size larger than that of the second gear 163. That is, the number of teeth of the first gear 161 may be larger than the number of teeth of the second gear 163. In other words, since the size of the first gear 161 is larger than the size of the second gear 163, the number of rotations of the second gear 163 may be larger than the number of rotations of the first gear 161. The gear ratio of the first gear 161 and the second gear 163 may cause the moving distance of the shelf fixing portion 140 to be longer than that of the shelf support portion 120, so that when the load of food stored on the shelf 40 increases, the shelf 40 may be fixed by the shelf fixing portion 140 at a greater fixing force. That is, as the load of food stored on the shelf 40 increases, the distance in the vertical direction between the shelf support portion 120 and the shelf fixing portion 140 is reduced, so that the fixing protrusion 145 of the shelf fixing portion 140 may be inserted deeper into the fixing groove 41 of the shelf 40. As described above, as the load of food stored on the shelf 40 increases, the fixing force of fixing the shelf 40 increases, so that the shelf 40 may be prevented from being separated from the shelf fixing device 100.

One side of the elastic member S may be supported on the first support portion 127 of the shelf support portion 120, and the other side of the elastic member S may be supported on the second support portion 117 of the case 110. When food is not stored on the shelf 40, the shelf support portion 120 may be caused to be located at a position higher than a position of the shelf support portion 120 when food is stored on the shelf 40 inside the case 110 by the elastic member S. When the load of food stored on the shelf 40 is increased, the shelf support portion 120 may be moved downward to compress the elastic member S. When the load of food stored on the shelf 40 is reduced, the shelf support portion 120 may be moved upward by the elastic force of the elastic member S.

Hereinafter, a change in the fixing force of the shelf fixing device 100 fixing the shelf 40 in response to a change in the load of food stored on the shelf 40 will be described.

Figure 7:
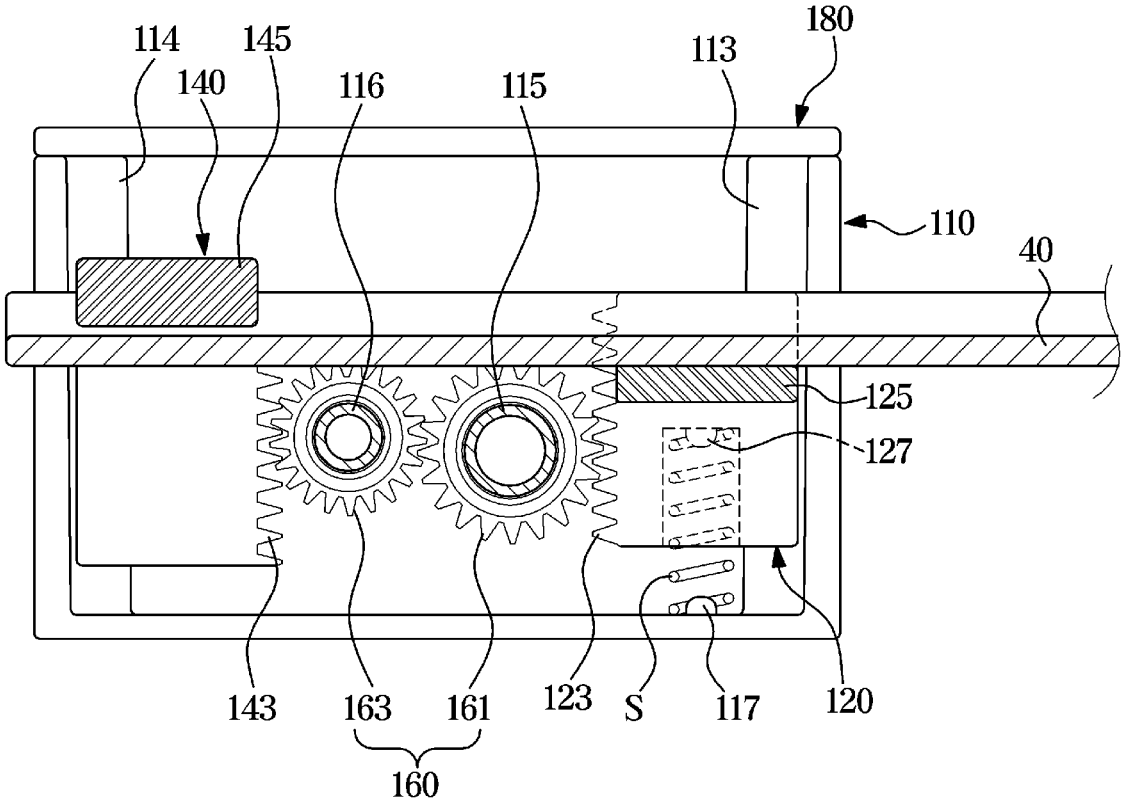
FIG. 7 is a cross-sectional view illustrating a shelf fixed to a shelf fixing device in a state of having no food stored thereon according to an embodiment of the disclosure.
Figure 8:
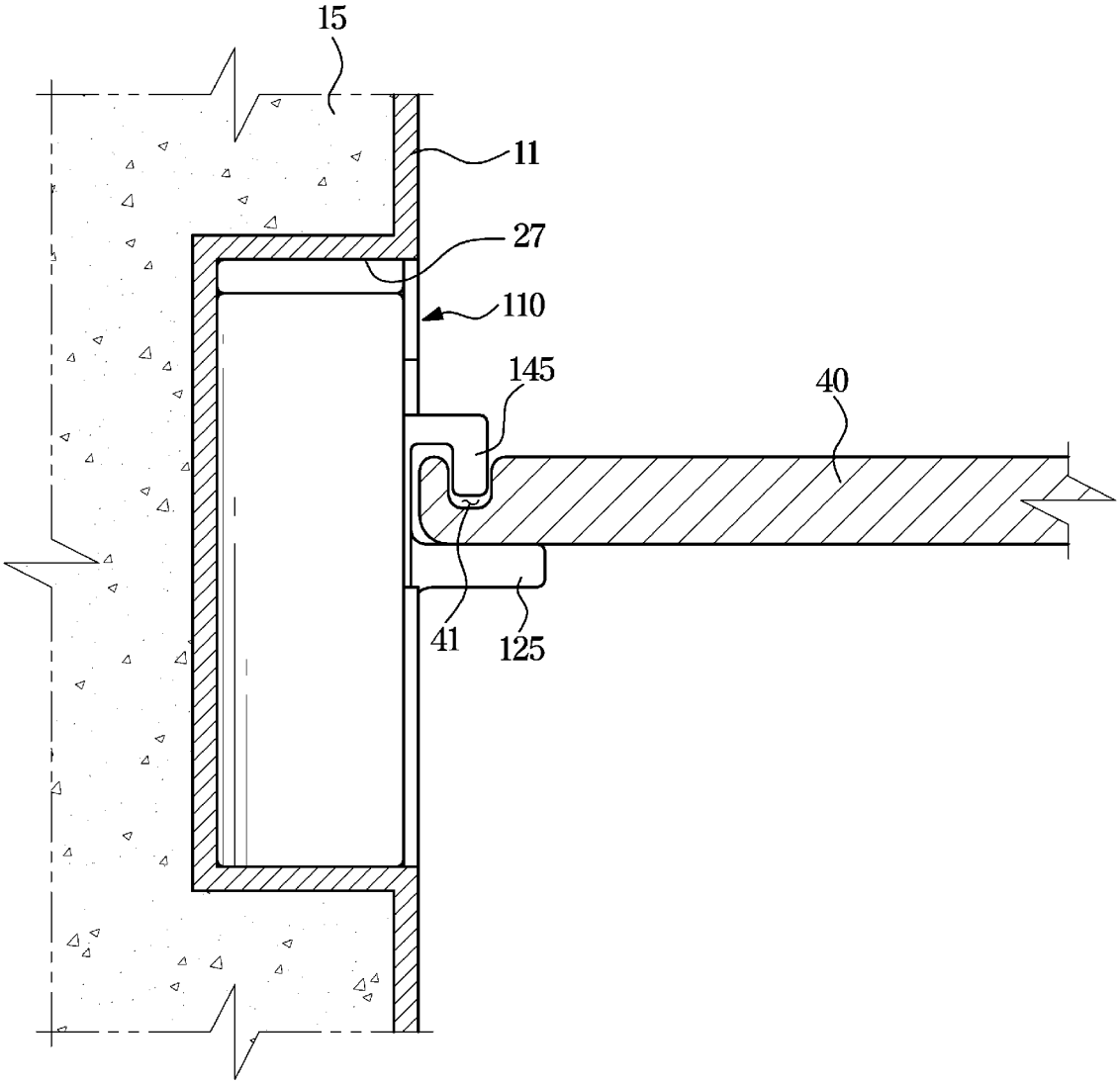
FIG. 8 is a cross-sectional view illustrating a state in which a fixing protrusion is inserted into a fixing groove without food stored on a shelf according to an embodiment of the disclosure.
Figure 9:
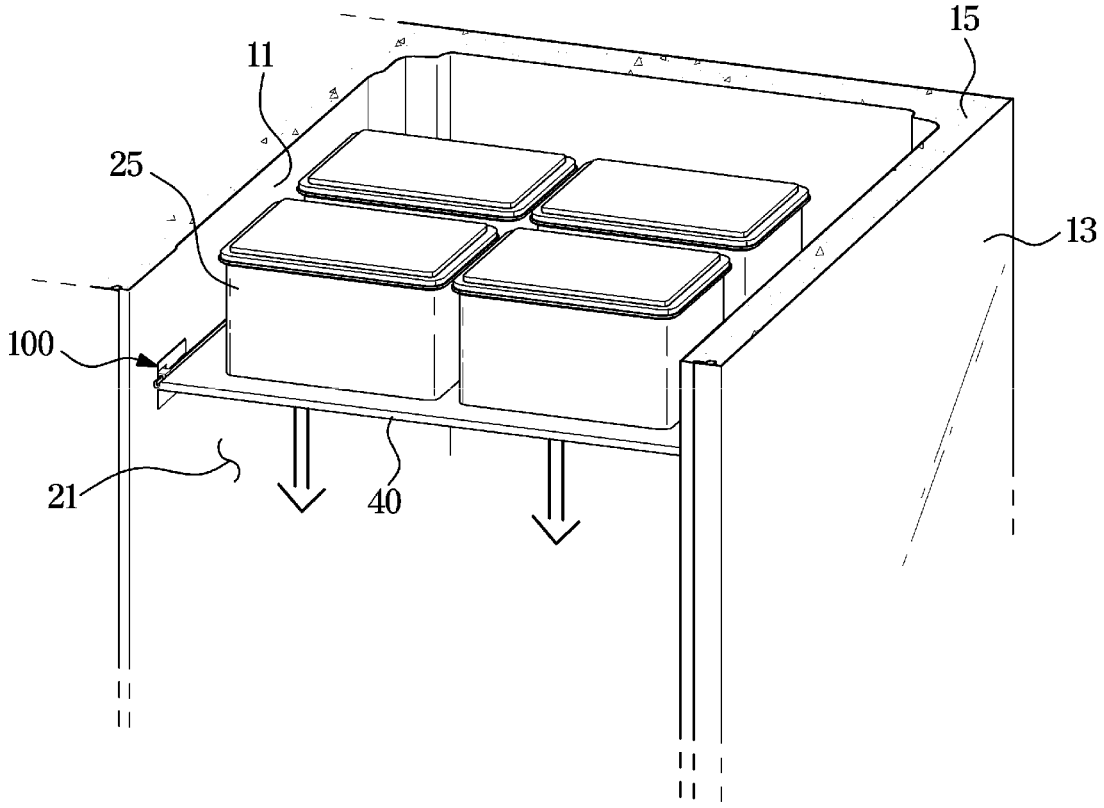
FIG. 9 is a view illustrating a state in which food is stored on a shelf according to an embodiment of the disclosure.
Figure 10:
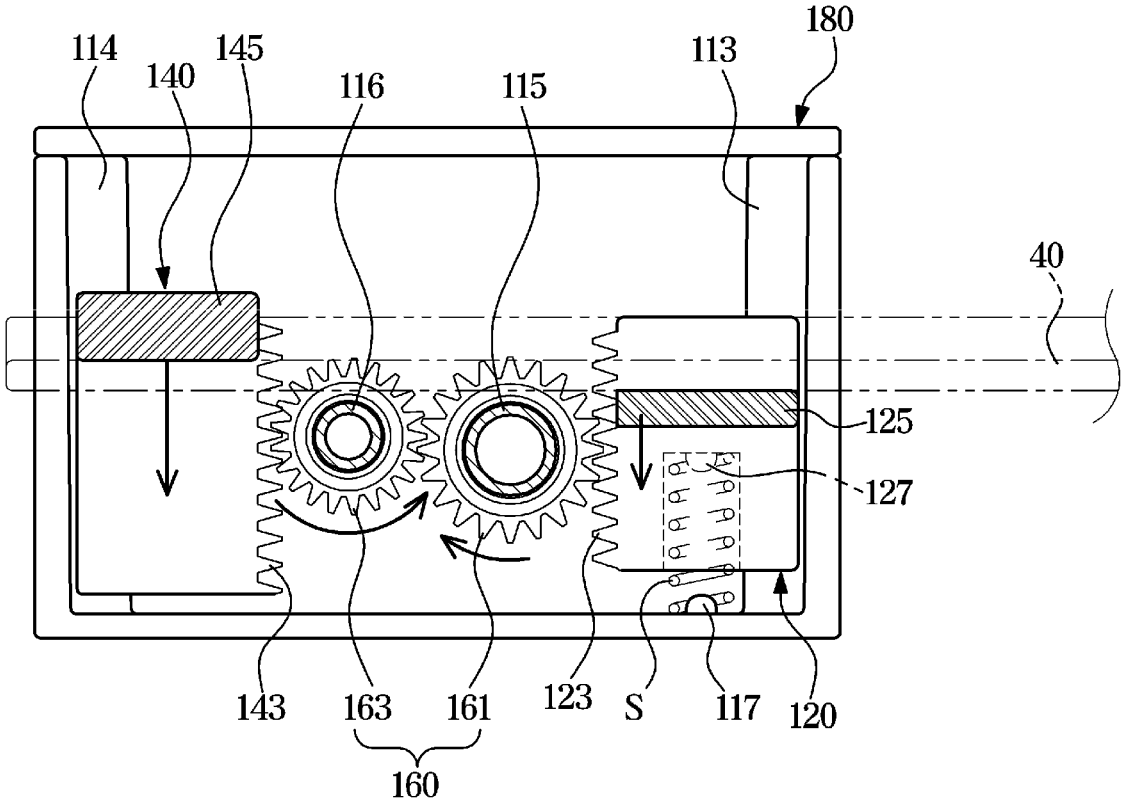
FIG. 10 is a cross-sectional view illustrating a state in which a shelf support portion and a shelf fixing portion are moved downward by a load of food stored on a shelf according to an embodiment of the disclosure.
Figure 11:
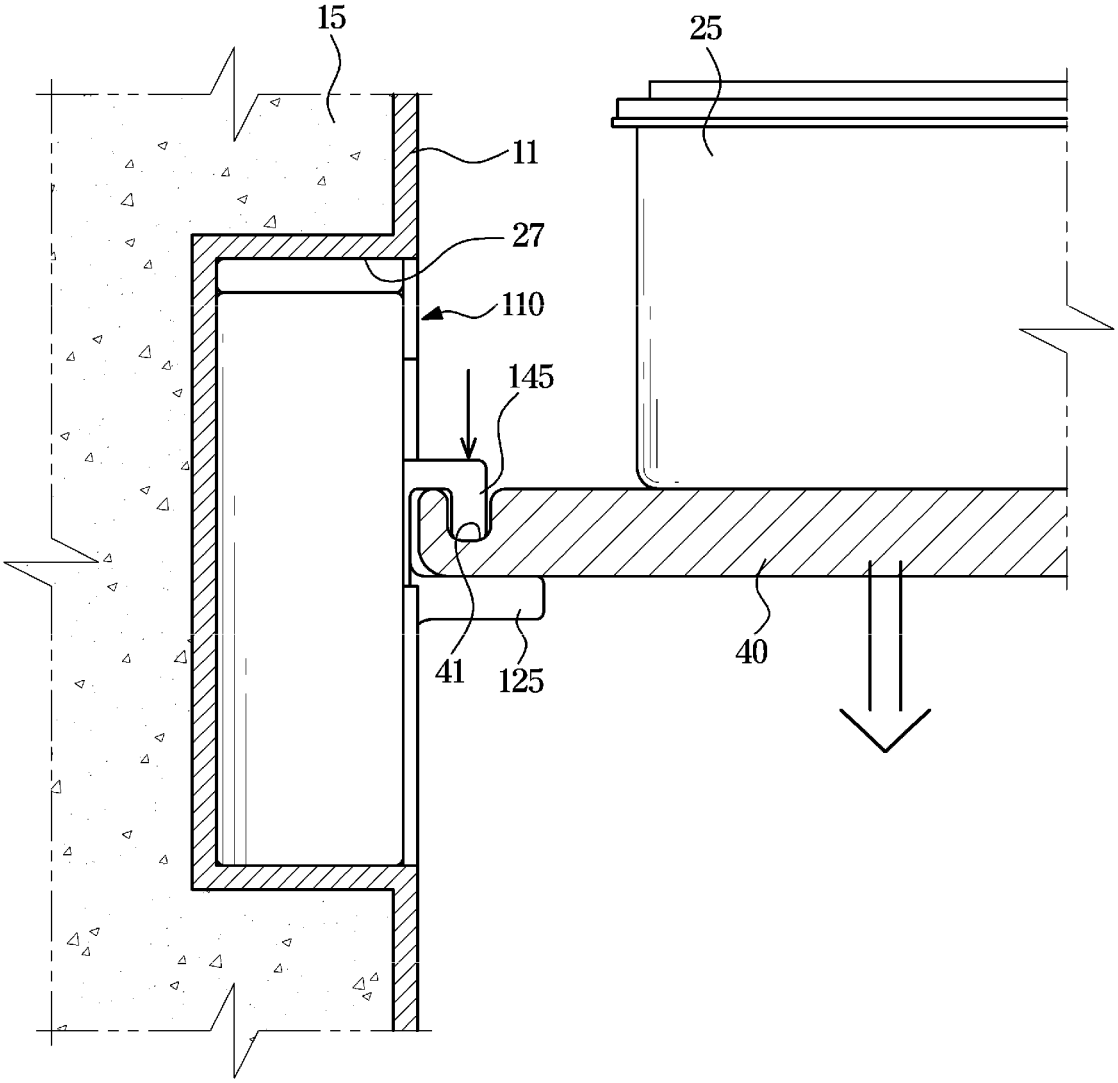
FIG. 11 is a cross-sectional view illustrating a state in which a fixing protrusion is inserted into a fixing groove with food stored on a shelf according to an embodiment of the disclosure.

FIG. 7 is a cross-sectional view illustrating a shelf fixed to a shelf fixing device in a state of having food stored thereon according to an embodiment of the disclosure. FIG. 8 is a cross-sectional view illustrating a state in which a fixing protrusion is inserted into a fixing groove without food stored on a shelf according to an embodiment of the disclosure. FIG. 9 is a view illustrating a state in which food is stored on a shelf according to an embodiment of the disclosure. FIG. 10 is a cross-sectional view illustrating a state in which a shelf support portion and a shelf fixing portion are moved downward by a load of food stored on a shelf according to an embodiment of the disclosure. FIG. 11 is a cross-sectional view illustrating a state in which a fixing protrusion is inserted into a fixing groove with food stored on a shelf according to an embodiment of the disclosure.

Referring to FIGS. 7 to 8, when no food is stored on the shelf 40, the shelf support portion 120 may be in a state of being slightly moved downward due to the load of the shelf 40. In this case, even when the fixing force of the shelf fixing device 100 is not great, the shelf 40 may not be easily separated from the shelf fixing device 100.

Referring to FIGS. 9 to 11, when food is stored in the storage container 25 on the shelf 40, the shelf support portion 120 may be moved downward by the first guide groove 121 being guided by the first guide protrusion 113 due to the load of the food. In this case, the elastic member S may be compressed by the shelf support portion 120.

When the shelf support portion 120 is moved downward, the first rack gear 123 may allow the first gear 161 to be rotated clockwise about the first rotation shaft 115. When the first gear 161 is rotated clockwise about the first rotation shaft 115, the second gear 163 may be rotated counterclockwise about the second rotation shaft 116. In this case, since the first gear 161 is larger than the second gear 163, the number of rotations of the second gear 163 may be larger than that of the first gear 161.

When the second gear 163 is rotated counterclockwise around the second rotation shaft 116, the second guide groove 141 being guided by the second guide protrusion 114 may allow the second rack gear 143 to be moved downward. In this case, since the number of rotations of the second gear 163 is larger than the number of rotations of the first gear 161, the shelf fixing portion 140 may be moved further downward than the shelf support portion 120. Accordingly, the vertical distance between the shelf support portion 120 and the shelf fixing portion 140 may be reduced. As the vertical distance between the shelf support portion 120 and the shelf fixing portion 140 decreases, the fixing protrusion 145 of the shelf fixing portion 140 is inserted deeper into the fixing groove 41 of the shelf 40 so that the fixing force of the fixing device 100 may be increased.

As described above, in proportion to the increasing load of food stored on the shelf 40, the fixing force of the shelf fixing device 100 fixing the shelf 40 increases, so that the shelf 40 is prevented from being separated from the shelf fixing device 100 even when the load of food stored on the shelf 40 increases.

When the food stored on the shelf 40 is removed from the shelf 40, the shelf support portion 120 may be moved upward by the first guide groove 121 being guided by the first guide protrusion 113 due to the elastic force of the elastic member S to a position that is the position of the shelf support t 120 when no food is stored on the shelf 40, as shown in FIGS. 7 and 8.

Although not shown in the drawing, when the shelf support portion 120 is moved upward, the first gear 161 may be rotated counterclockwise around the first rotation shaft 115, and the second gear 163 may be rotated clockwise around the second rotation shaft 116. When the second gear 163 is rotated clockwise around the second rotation shaft 116, the shelf fixing portion 140 may be moved upward by the second guide groove 141 being guided by the second guide protrusion 114. Even in this case, since the distance moved by the shelf fixing portion 140 upward is larger than the distance moved by the shelf support portion 120 upward, the fixing force of the shelf fixing device 100 may be reduced. Since food is not stored on the shelf 40, even when the fixing force of the shelf fixing device 100 is small, separation of the shelf 40 may be prevented.

Figure 12:
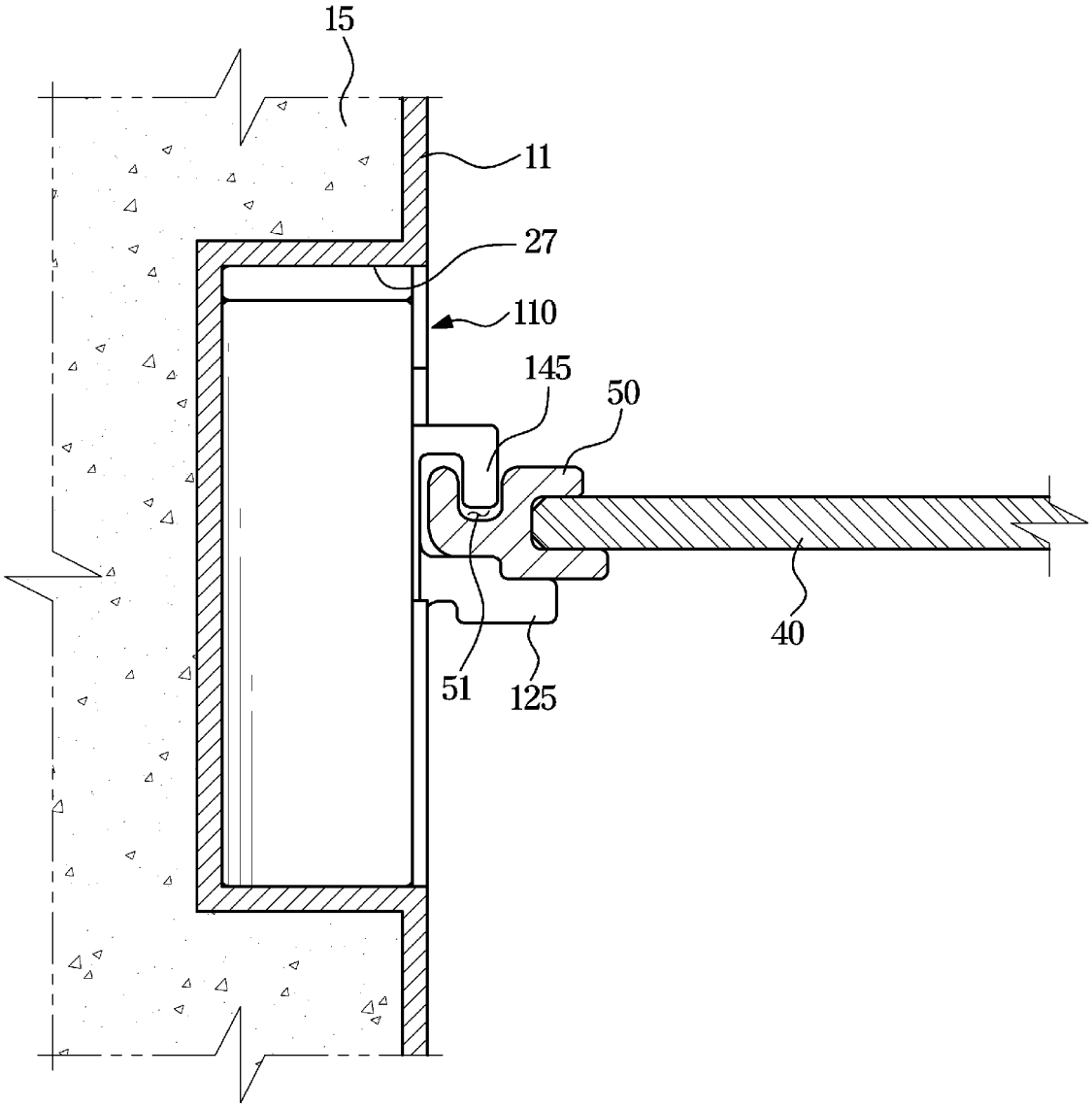
FIG. 12 is a view illustrating a state in which fixing members are coupled to opposite side edges of a shelf according to another embodiment of the disclosure.

FIG. 12 is a view illustrating a state in which fixing members are coupled to opposite side edges of a shelf according to another embodiment of the disclosure.

Referring to FIG. 12, fixing members 50 formed with fixing grooves 51 may be coupled to opposite side edges of the shelf 40. Compared to the above configuration shown in FIG. 8 in which the fixing grooves 41 are integrally formed with the opposite side edges of the shelf 40, the configuration of fixing the shelf 40 by the shelf fixing device 100 according to the embodiment shown in FIG. 12 may be the same as that of FIG. 8 except that the fixing members 50 having the fixing grooves 51 are provided separately and coupled to the opposite side edges of the shelf 40.

Figure 13:
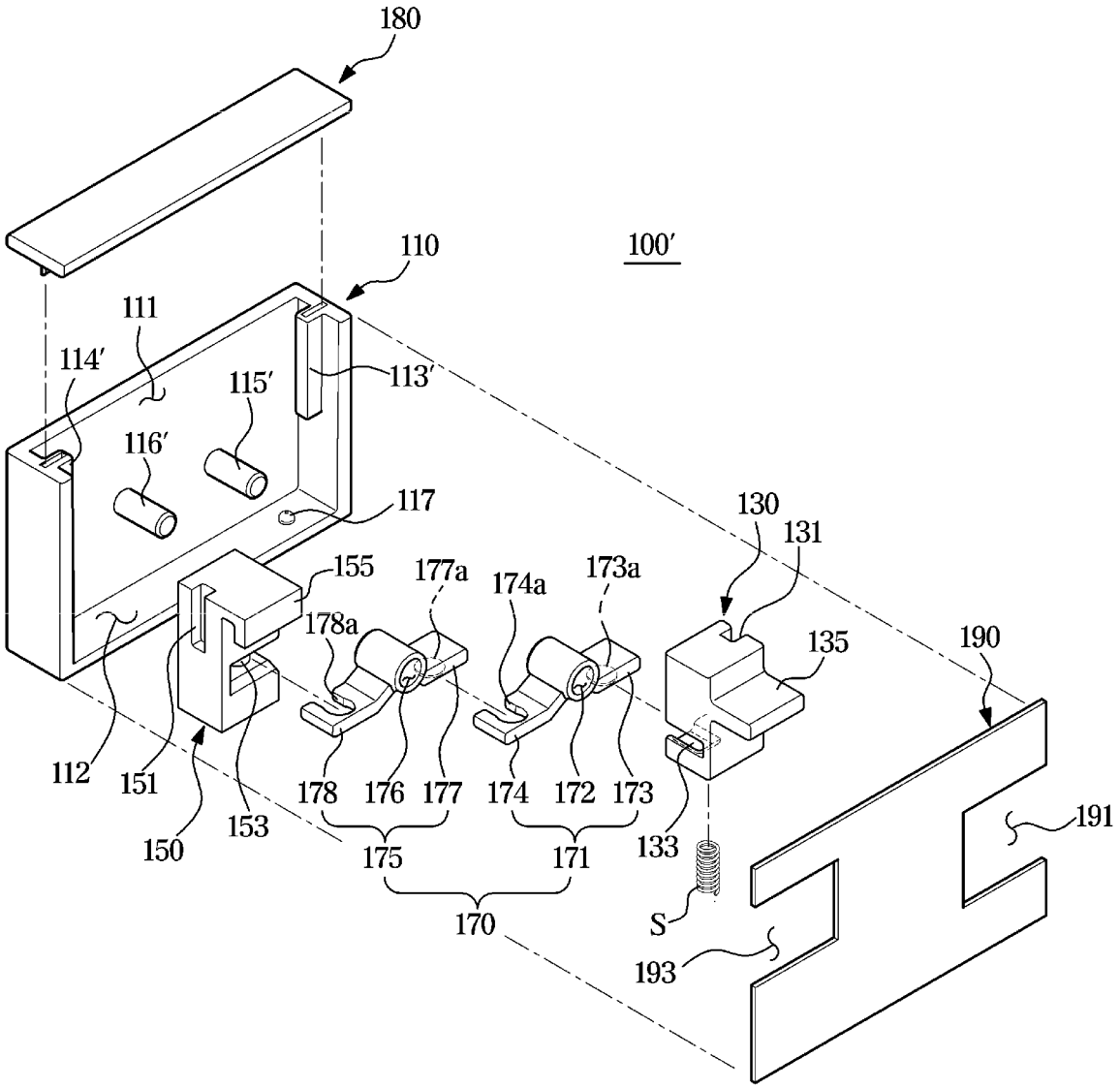
FIG. 13 is an exploded perspective view illustrating a shelf fixing device according to another embodiment of the disclosure.
Figure 14:
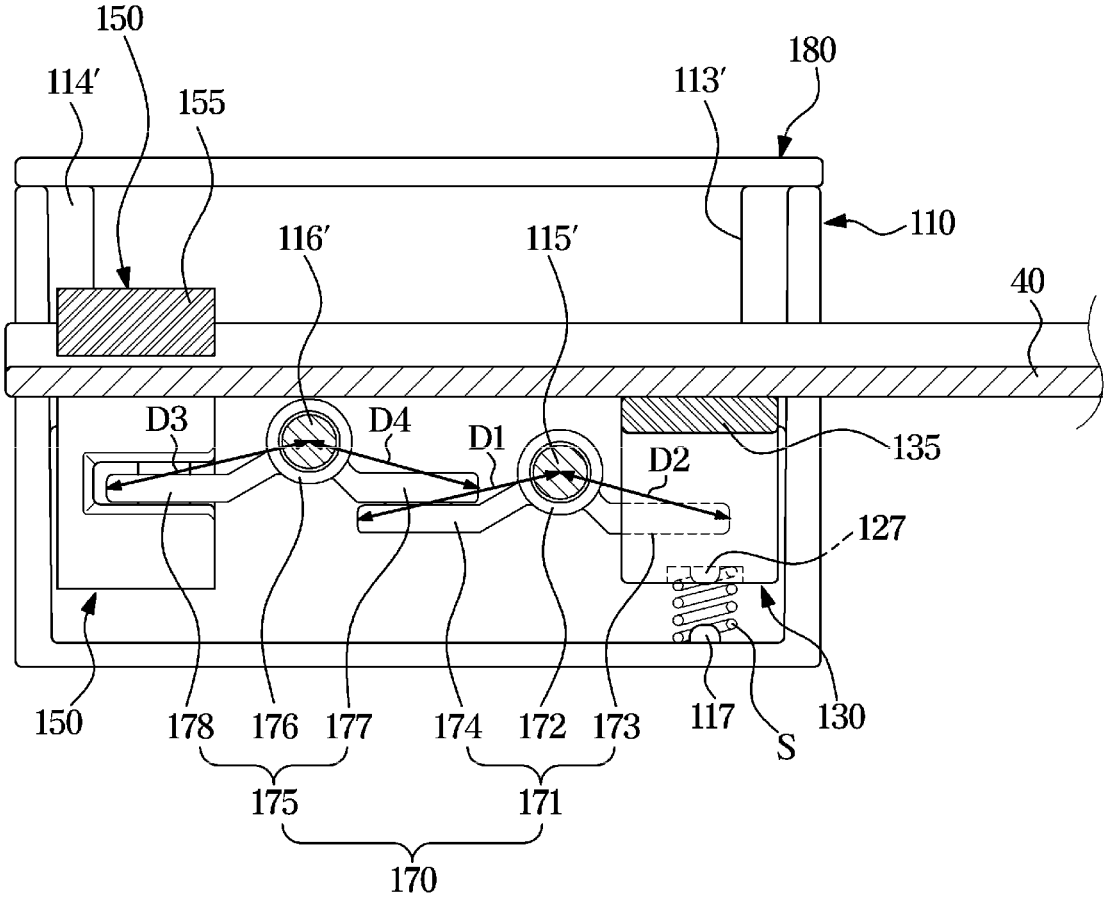
FIG. 14 is a cross-sectional view illustrating a state in which a shelf is fixed to a shelf fixing device without food stored thereon according to another embodiment of the disclosure.
Figure 15:
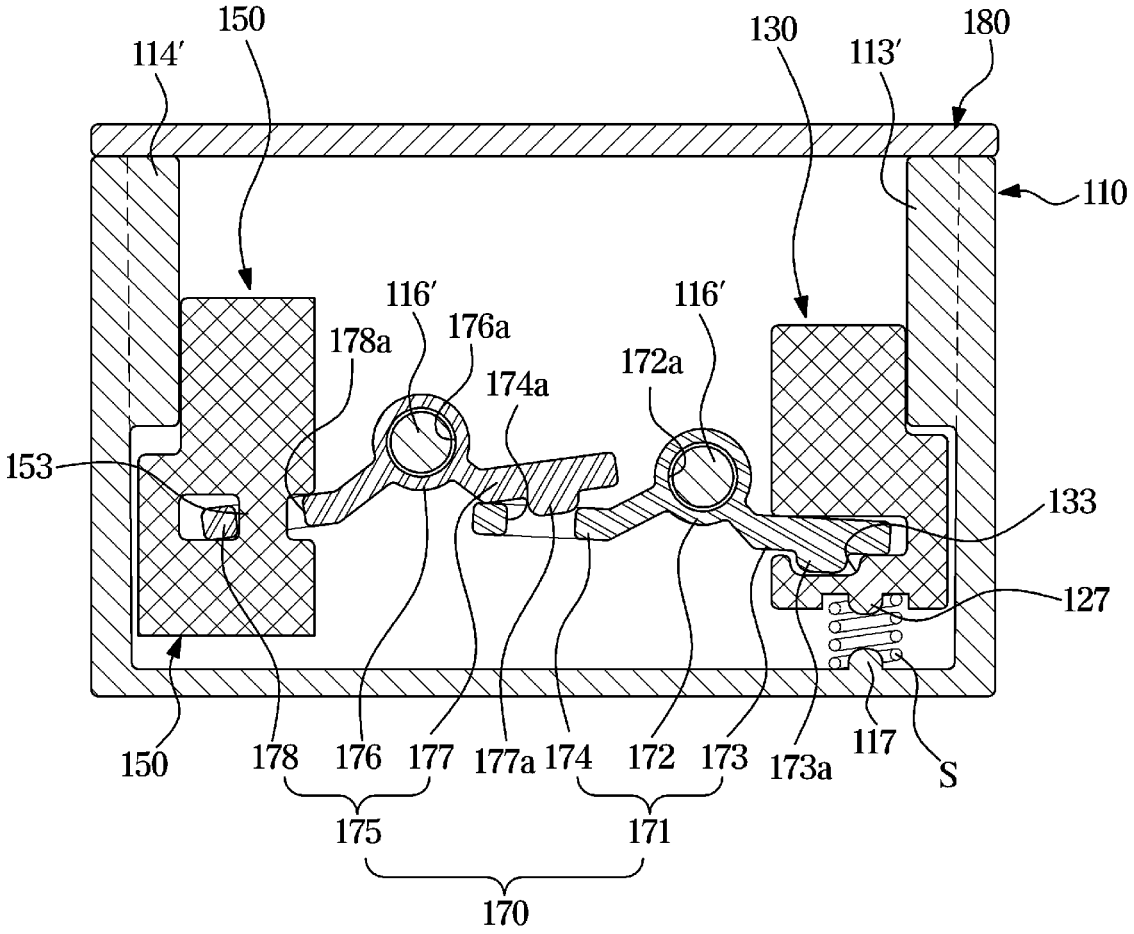
FIG. 15 is a cross-sectional view illustrating a state in which a shelf support portion and a shelf fixing portion are moved downward by a load of food stored on a shelf according to another embodiment of the disclosure.

FIG. 13 is an exploded perspective view illustrating a shelf fixing device according to another embodiment of the disclosure. FIG. 14 is a cross-sectional view illustrating a state in which a shelf is fixed to a shelf fixing device without food stored thereon according to another embodiment of the disclosure. FIG. 15 is a cross-sectional view illustrating a state in which a shelf support portion and a shelf fixing portion are moved downward by a load of food stored on a shelf according to another embodiment of the disclosure.

Referring to FIGS. 13 to 14, a shelf fixing device 100' includes a case 110, a shelf support portion 130 provided inside the case 110 to support a shelf 40, a shelf fixing portion 150 provided inside the case 110 to fix the shelf 40, a connecting portion 167 disposed inside the case 110 to connect the shelf support portion 130 to the shelf fixing portion 150, and an elastic member S elastically supporting the shelf support 130 at a lower side of the shelf support portion 130.

The cases 110 may be inserted into a pair of insertion grooves 27 formed on each of opposite sidewalls of the storage compartment 20 (see FIG. 2). Since the configuration of the case 110 is slightly different from the case 110 shown in FIG. 5 in the shape of some components, components having shapes identical to those described above will be omitted. The case 110 may include a first opening 111 and a second opening 112. Inside the case 110, the shelf support portion 130, the shelf fixing portion 150, the connecting portion 170, and the elastic member S may be provided. The shelf support portion 130, the shelf fixing portion 150, the connecting portion 170, and the elastic member S may be disposed inside the case 110 through the first opening 111 and the second opening 112.

The shelf fixing device 100 may further include a first cover 180 and a second cover 190. The second cover 190 includes a first opening portion 191 through which a support plate 135 of the shelf support portion 130 is protruded, and a second opening portion 193 through which a fixing protrusion 155 of the shelf fixing portion 150 is protruded.

The case 110 includes a first guide protrusion 113' for guiding the shelf support portion 130 to move in the vertical direction, and a second guide protrusion 114' for guiding the shelf fixing portion 150 to move in the vertical direction. The first guide protrusion 113' may be provided on one of the opposite sidewalls of the case 110. The second guide protrusion 114' may be provided on a sidewall opposite to the one sidewall of the case 110 on which the first guide protrusion 113' is provided.

The case 110 includes a first rotation shaft 115' to which a first rotation member 171 of the connecting portion 170 to be described below is fixed so as to enable a rotation, a second rotation shaft 116' to which a second rotation member 175 is fixed so as to enable a rotation, and a second support portion 117 on which the elastic member S is supported.

The shelf support portion 130 includes a first guide groove 131 guided by the first guide protrusion 113' of the case 110, a first connecting portion 133 to which a first extension portion 173 of the connecting portion 170 is connected, a support plate 135 protruded to the outside of the case 110 through the first opening portion 191 of the second cover 190 to support the shelf 40, and a first support portion 137 on which the elastic member S is supported.

The first guide groove 131 of the shelf support portion 130 is guided by the first guide protrusion 113' of the case 110 so that the shelf support portion 130 may be moved in the vertical direction.

The first connecting portion 133 may be formed as a depression to be connected to the first extension portion 173 of the first rotating member 171. The first connecting portion 133 may allow the first rotating member 171 to be rotated about a first rotation hole 172 when the shelf support portion 130 is moved in the vertical direction. When the shelf support portion 130 is moved downward, the first rotating member 171 may be rotated clockwise around the first rotation hole 172.

The support plate 135 may be protruded to the outside of the case 110 through the first opening portion 191 of the second cover 190 to support the lower portion of the shelf 40. The first opening portion 191 may form a space in which the support plate 135 moves in the vertical direction when the shelf support portion 120 is moved in the vertical direction.

The first support portion 137 may be provided to have one side of the elastic member S elastically supported thereon. The other side of the elastic member S may be elastically supported on the second support portion 117 provided on the case 110. Since the one side and the other side of the elastic member S are elastically supported on the shelf support portion 130 and the lower surface of the case 110, respectively, when the shelf 40 has a small load, the shelf support portion 130 may be located at the highest position inside the case 110. That is, when food is not stored on the shelf 40, the shelf support portion 130 may be provided to be located at the highest position inside the case 110 by the elastic member S. When the shelf support portion 130 is referred to as being located at the highest position inside the case 110, the highest position may represent the height of the shelf support portion 130 relative to the height of the shelf support portion 130 when food is stored on the shelf 40. That is, when the shelf 40 is not fixed by the shelf fixing device 100', the shelf support portion 130 may be located at the highest position inside the case 110.

The shelf fixing portion 150 may include a second guide groove 151 guided by the second guide protrusion 114' of the case 110, a second connecting portion 153 to which a fourth extension portion 178 of the connecting portion 170 is connected, and a fixing protrusion 155 that is protruded to the outside of the case 110 through the second opening portion 193 of the second cover 190 to fix the shelf 40.

The second guide groove 151 of the shelf fixing portion 150 is guided by the second guide protrusion 114' of the case 110 so that the shelf fixing portion 150 may be moved in the vertical direction.

The second connecting portion 153 may be formed as a protrusion to be connected to the fourth extension portion 178 of the second rotating member 175. The second connecting portion 153 may, when the second rotating member 175 is rotated by the first rotating member 171, allow the shelf fixing portion 150 to be moved in the vertical direction.

The fixing protrusion 155 may be protruded to the outside of the case 110 through the second opening portion 193 of the second cover 190 to fix the shelf 40 at the upper side of the shelf 40. The second opening portion 193 may form a space in which the fixing protrusion 155 moves in the vertical direction when the shelf fixing portion 150 is moved in the vertical direction.

In order that the shelf 40 is fixed by the fixing protrusion 155, fixing grooves 41 may be provided on opposite side edges of the shelf 40. The fixing protrusion 155 is inserted into the fixing groove 41 to prevent the shelf 40 from being separated (see FIGS. 4 and 8).

The connecting portion 170 may be disposed between the shelf support portion 130 and the shelf fixing portion 150 to connect the shelf support portion 130 to the shelf fixing portion 150. The connecting portion 170 may include a pair of rotating members 171 and 175 which are rotated in linkage with the shelf support portion 130 and the shelf fixing portion 150, respectively.

The connecting portion 170 may include the first rotating member 171 rotated about the first rotation shaft 115' and the second rotating member 175 rotated about the second rotation shaft 116'.

The first rotating member 171 may include a first rotation hole 172 fixed to the first rotation shaft 115' of the case 110 so as to enable a rotation and serving as a center of rotation, a first extension portion 173 extending from the first rotation hole 172 in a direction toward the shelf support portion 130 and connected to the shelf support portion 130, and a second extension portion 174 extending from the first rotation hole 172 in a direction toward the shelf fixing portion 150.

The second rotating member 175 may include a second rotation hole 176 fixed to the second rotation shaft 116' of the case 110 so as to enable a rotation and serving as a center of rotation, a third extension portion 177 extending from the second rotation hole 176 in a direction toward the shelf support portion 130 and connected to the second extension portion 174, and a fourth extension portion 178 extending from the second rotation hole 176 in a direction toward the shelf fixing portion 150 and connected to the shelf fixing portion 150.

The first extension portion 173 may include a first connecting protrusion 173*a* connected to the first connecting portion 133 formed as a depression in the shelf support portion 130. The second extension portion 174 may include a first connection groove 174*a* connected to the third extension portion 177. The third extension portion 177 may include a second connecting protrusion 177*a* connected to the first connection groove 174*a* of the second extension portion 174. The fourth extension portion 178 may include a second connecting groove 178*a* connected to the second connecting portion 153 formed as a protrusion in the shelf fixing portion 150.

The first rotating member 171 may be provided such that the distance D1 between the end of the second extension portion 174 and the center of the first rotation hole 172 is longer than the distance D2 between the end of the first extension portion 173 and the center of the first rotation hole 172.

The second rotating member 175 may be provided such that the distance D3 between the end of the fourth extension portion 178 and the center of the second rotation hole 176 is longer than the distance D4 between the end of the third extension portion 177 and the second rotation hole 176. In this case, the distance D1 between the end of the second extension portion 174 and the center of the first rotation hole 172 may be equal to the distance D3 between the end of the fourth extension portion 178 and the center of the second rotation hole 176. In addition, the distance D2 between the end of the first extension portion 173 and the center of the first rotation hole 172 may be equal to the distance between the end of the third extension portion 177 and the center of the second rotation hole 176.

The connecting portion 170 may allow the shelf fixing portion 150 to move at a distance greater than that moved by the shelf support portion 130 on the basis of a difference in lengths of the first extension portion 173 and the second extension portion 174 of the first rotating member 171 and a difference in lengths of the third extension portion 177 and the fourth extension portion 178 of the second rotating member 175. That is, the distance D1 between the end of the second extension portion 174 and the center of the first rotation hole 172 and the distance D3 between the end of the fourth extension portion 178 and the center of the second rotation hole 176 are set to be longer than the distance D2 between the end of the first extension portion 173 and the center of the first rotation hole 172 and the distance D4 between the end of the third extension portion 177 and the center of the second rotation hole 176, respectively, so that the torque of the second rotating member 175 may be provided to be greater than that of the first rotating member 171. With such a configuration, the moving distance of the shelf fixing portion 150 may be provided to be greater than that of the shelf support portion 130.

Referring to FIG. 15, when food is stored in the storage container 25 on the shelf 40, the shelf support portion 130 may be moved downward by the first guide groove 131 being guided by the first guide protrusion 113' by the load of the food. In this case, the elastic member S may be compressed by the shelf support portion 130 (see FIG. 9).

When the shelf support portion 130 is moved downward, the first rotating member 171 may be rotated clockwise around the first rotation hole 172. When the first rotating member 171 is rotated clockwise around the first rotation hole 172, the second rotating member 175 may be rotated counterclockwise around the second rotation hole 176. In this case, since the distance D1 between the end of the second extension portion 174 and the center of the first rotation hole 172 and the distance D3 between the end of the fourth extension portion 178 and the center of the second rotation hole 176 are set to be longer than the distance D2 between the end of the first extension portion 173 and the center of the first rotation hole 172 and the distance D4 between the end of the third extension portion 177 and the center of the second rotation hole 176, respectively, the torque of the second rotating member 175 may be provided to be greater than that of the first rotating member 171.

When the second rotating member 175 is rotated counterclockwise around the second rotation hole 176, the shelf fixing portion 150 may be moved downward by the second guide groove 151 being guided by the second guide protrusion 114'. In this case, since the torque of the second rotating member 175 is greater than the torque of the first rotating member 171, the shelf fixing portion 145 may be moved further downward than the shelf support portion 130. Accordingly, the vertical distance between the shelf support portion 130 and the shelf fixing portion 150 may be narrowed. As the vertical distance between the shelf support portion 130 and the shelf fixing portion 150 is narrowed, the fixing protrusion 155 of the shelf fixing portion 150 is inserted deeper into the fixing groove 41 of the shelf 40 so that the fixing force of the shelf fixing device 100' may be increased (see FIG. 11).

As described above, in proportion to the increasing load of food stored on the shelf 40, the fixing force of the shelf fixing device 100' fixing the shelf 40 increases, so that even when the load of food stored on the shelf 40 increases, the shelf 40 may be prevented from being separated from the shelf fixing device 100'.

As is apparent from the above, the fixing force of fixing a shelf increases as the load of food stored on the shelf increases, so that the shelf can be prevented from being separated.

What is claimed is:

1. A refrigerator comprising:

a main body;

a storage compartment provided in the main body, the storage compartment configured to have a shelf arranged therein; and shelf fixing devices provided at opposite sidewalls inside the storage compartment to fix the shelf, wherein each of the shelf fixing devices includes:

a shelf support portion configured to support a lower side of the shelf and to move in a downward direction as a load on the shelf increases;

a shelf fixing portion configured to fix the shelf at an upper side of the shelf and to move in the downward direction together with the shelf support portion; and a connecting portion positioned between the shelf support portion and the shelf fixing portion and configured to connect the shelf support portion to the shelf fixing portion, and allow the shelf fixing portion to move along a first path and the shelf support portion to move along a second path shorter than the first path, to adjust a distance between the shelf support portion and the shelf fixing portion according to the load on the shelf so that a fixing force on the shelf is changed, and wherein as the load on the shelf increases, the distance in a vertical direction between the shelf support portion and the shelf fixing is reduced.

2. The refrigerator of claim 1, wherein the connecting portion includes a pair of gears each rotatable in linkage with a corresponding one of the shelf support portion and the shelf fixing portion, the pair of gears having different sizes.

3. The refrigerator of claim 1, wherein the connecting portion includes a first gear engaged with the shelf support portion and rotatable relative to the shelf support portion, and a second gear engaged with the shelf fixing portion and the first gear and the second gear rotatable relative to the shelf fixing portion and the first gear and being smaller than the first gear.

4. The refrigerator of claim 3, wherein the shelf fixing devices includes a pair of shelf fixing devices at each of the opposite sidewalls of the storage compartment, and each of the opposite sidewalls includes a pair of insertion grooves into which the pair of shelf fixing devices are inserted, respectively.

5. The refrigerator of claim 4, wherein the shelf fixing devices are inserted into an insertion groove of the pair of insertion grooves, respectively, and each of the shelf fixing devices further include:

a case having a first opening provided to be open at an upper side thereof and a second opening provided to be open in a direction opposite to a direction in which the case is inserted into the insertion groove of the pair of insertion grooves;

a first cover configured to cover the first opening;

a second cover configured to cover the second opening; and an elastic member elastically supporting a lower portion of the shelf support portion.

6. The refrigerator of claim 5, wherein the case includes a first guide protrusion configured to guide the shelf support portion to move in upper and lower side directions, and a second guide protrusion configured to guide the shelf fixing portion to move in the upper and lower side directions.

7. The refrigerator of claim 6, wherein the shelf support portion includes a first guide groove guided by the first guide protrusion, a first rack gear engaged with the first gear, a support plate protruded outside of the case to support the shelf, and a first support portion on which one side of the elastic member is supported.

8. The refrigerator of claim 7, wherein the shelf fixing portion includes a second guide groove guided by the second guide protrusion, a second rack gear engaged with the second gear, and a fixing protrusion protruded outside of the case to fix the shelf.

9. The refrigerator of claim 8, wherein the second cover includes a first opening portion to form a space in which the support plate protruded outside of the case is movable in the upper and lower side directions, and a second opening to form a space in which the fixing protrusion protruded outside of the case is movable in the upper and lower side directions.

10. The refrigerator of claim 9, wherein the case includes a first rotation shaft to which the first gear is fixed so as to enable a rotation, a second rotation shaft to which the second gear is fixed so as to enable a rotation, and a second support portion on which an other side of the elastic member is supported.

11. The refrigerator of claim 10, wherein the shelf has opposite side edges thereof formed with fixing grooves that are fixed by the fixing protrusions.

12. The refrigerator of claim 10, wherein the shelf has opposite side edges to which fixing members allowing the shelf fixing portion to fix the shelf are coupled, the fixing members including fixing grooves that are fixed by the fixing protrusion.

13. The refrigerator of claim 1, wherein the connecting portion includes:

a first rotating member including a first rotation hole serving as a center of rotation, a first extension portion formed to extend from the first rotation hole in a direction toward the shelf support portion to be connected to the shelf support portion, and a second extension portion formed to extend from the first rotation hole in a direction toward the shelf fixing portion; and a second rotating member including a second rotation hole serving as a center of rotation, a third extension portion formed to extend from the second rotation hole in a direction toward the shelf support portion to be connected to the second extension portion, and a fourth extension portion formed to extend from the second rotation hole in a direction toward the shelf fixing portion to be connected to the shelf fixing portion.

14. The refrigerator of claim 13, wherein a distance between an end tip of the second extension portion and a center of the first rotation hole is longer than a distance between an end tip of the second extension portion and the center of the first rotation hole, and a distance between an end tip of the fourth extension portion and a center of the second rotation hole is longer than a distance between an end tip of the third extension portion and the center of the second rotation hole.

15. The refrigerator of claim 14, wherein the shelf support portion includes a first connecting portion to which the first extension portion is connected, and the shelf fixing portion includes a second connecting portion to which the fourth extension portion is connected.

16. A refrigerator comprising:

a main body;

a storage compartment provided in the main body, the storage compartment configured to have a shelf arranged therein; and shelf fixing devices provided at opposite sidewalls inside the storage compartment to fix the shelf, wherein each of the shelf fixing devices include:

a shelf support portion configured to support a lower side of the shelf and move in a downward direction as a load on the shelf increases;

a shelf fixing portion configured to fix the shelf at an upper side of the shelf, and move in the downward direction together with the shelf support portion; and a connecting portion positioned between the shelf support portion and the shelf fixing portion and including a pair of gears configured to connect the shelf support portion to the shelf fixing portion, the connecting portion allowing the shelf fixing portion and the shelf support portion to have different moving lengths on the basis of a gear ratio of the pair of gears so that a fixing force on the shelf is changed according to the load of on the shelf, and wherein as the load of the shelf increases, the distance in the vertical direction between the shelf support portion and the shelf fixing portion is reduced.

17. The refrigerator of claim 16, wherein the pair of gears include:

a first gear engaged with the shelf support portion and rotatable relative to the shelf support portion; and a second gear engaged with the shelf fixing portion and the first gear and rotatable relative to the shelf fixing portion and the first gear, the second gear having a larger number of rotations larger the first gear.

18. The refrigerator of claim 17, wherein the shelf support portion includes a first rack gear engaged with the first gear, and a support plate configured to support the shelf, and the shelf fixing portion includes a second rack gear engaged with the second gear, and a fixing protrusion configured to fix the shelf.

19. The refrigerator of claim 18, wherein the shelf has opposite side edges thereof formed with fixing grooves that are fixed by the fixing protrusions.

20. The refrigerator of claim 19, wherein as the load on the shelf increases, the fixing force with which the fixing protrusion is fixed to the fixing groove increases.

* * * * *